United States Patent [19]

Lofton

[11] Patent Number: 4,899,878

[45] Date of Patent: Feb. 13, 1990

[54] CHRISTMAS TREE DISPOSAL BAG

[76] Inventor: Hugh Lofton, 3565 Linden Ave., Long Beach, Calif. 90807

[21] Appl. No.: 303,244

[22] Filed: Jan. 30, 1989

[51] Int. Cl.[4] ..... B65D 65/04

[52] U.S. Cl. ..... 206/423

[58] Field of Search ..... 206/423; 47/21; 383/4

[56] References Cited

U.S. PATENT DOCUMENTS

| | | | |
|---|---|---|---|
| 283,837 | 8/1983 | Wallace . | |
| 2,748,516 | 6/1956 | McClusky | 41/15 |
| 2,766,797 | 10/1955 | Cowen | 150/52 |
| 2,781,811 | 2/1957 | Dilar | 150/52 |
| 2,868,255 | 1/1959 | Fancher | 150/52 |
| 2,911,025 | 11/1959 | Paros | 150/52 |
| 2,934,204 | 4/1960 | Pardee | 206/46 |
| 3,249,140 | 5/1966 | Jackson | 150/52 |
| 3,729,039 | 4/1973 | Walsh | 150/52 |
| 3,750,731 | 8/1973 | Brimmell | 150/52 |
| 3,924,669 | 12/1975 | Price | 150/52 |
| 3,954,129 | 5/1976 | Rudell et al. | 150/52 |
| 4,054,166 | 10/1977 | Burke | 105/52 |
| 4,058,956 | 11/1977 | Skonieczny | 56/1 |
| 4,206,795 | 6/1980 | Regan | 150/52 |
| 4,248,347 | 2/1981 | Trimbee | 206/423 |
| 4,581,277 | 3/1986 | Neale | 428/181 |

*Primary Examiner*—Stephen P. Garbe

*Attorney, Agent, or Firm*—Fulwider, Patton, Lee & Utecht

[57] ABSTRACT

A combination Christmas tree disposal bag and underlay which in its folded and covered form neatly stows beneath the tree, unfolds to provide a large area cover sheet and subsequently serves to enshroud the entire Christmas tree to facilitate litter-free removal thereof from within the home.

13 Claims, 2 Drawing Sheets

CHRISTMAS TREE DISPOSAL BAG

BACKGROUND OF THE INVENTION

This invention relates to tree wrappers, and more specifically, pertains to a disposal bag for cut Christmas trees and the like.

At the close of the Christmas season the disposal of the customary Christmas tree often becomes nuisance. By that time the Christmas tree has typically dried out and is therefore prone to shedding needles at the slightest contact. The removal of ornaments and decorations therefrom aggravates the tendency to shed and litter, and the actual removal of the tree from within the home brings this problem to a head. During its disposal, the tree is typically carried through doorways and in and around furniture and needles which might have remained on the tree up until that time are easily brushed off by contact with the door jams and furniture, thus leaving a trail of needles between the place of display and the place of disposal outside. Once outside awaiting collection, the dry tree poses a fire hazard. Whether ignited by accident or maliciousness, a burning dry tree can quickly cause fire to spread to the surroundings.

Devices and wrappers addressing these problems have been know for some time, and by way of example, several forms of such devices can be found in U. S. Pat. Nos. 2,781,811, 2,868,255, 3,729,039, 3,750,731, and 3,954,129. Apparent shortcomings associated with the devices found in the above-indicated disclosures relate to the expense of manufacture, the bulkiness of the device prior to deployment and the ease of deployment.

SUMMARY OF THE INVENTION

The present invention provides an extremely inexpensive Christmas tree disposal bag that stows in a particularly compact and unobtrusive configuration below the Christmas tree. From this compact configuration, the bag unfolds to provide a large, flat surface which is capable of catching all debris falling off the tree during the removal of ornaments and decoration. Simply lifting the periphery of the bag to the top of the tree and pulling a drawstring yields a package that allows the tree to be removed from within a dwelling without the usual associated mess. The use of a fire-retardant material or treatment of the material with a fire-retardant chemical reduces the fire hazard the tree may pose awaiting collection at curbside.

More specifically, the disposal bag of the present invention is fashioned from a single piece of flat sheeting material, thereby avoiding complex manufacturing operations otherwise required to yield either the cylindrical or conical configurations prevalent in the prior art. Inclusion of a centrally disposed hole for accommodating the Christmas tree's trunk and the affixation of a drawstring about the periphery of the sheeting material completes the construction of the disposal bag. The periphery of the sheeting material may either take the form of a regular polygon or a circle. Such geometric figures allow the sheeting material to be compactly and neatly folded about the centrally located hole. An easily removable decorative overlay maintains the disposal bag in its folded configuration and a hole therein coincides with the central hole in the sheeting material to allow the tree to be inserted through the entire folded and covered package. The sheeting material is dimensioned such that the distance from its centrally located hole to its periphery approximates the height of the Christmas tree. An added advantage of its completely flat configuration is that once unfolded, the sheet provides a large and flat surface capable of catching all debris falling from the tree.

Other features and advantages of the present invention will become apparent from the following detailed description, taken in conjunction with the accompanying drawing which illustrate by way of example the principles of the invention.

DETAILED DESCRIPTION OF THE PREFERRED EMBODIMENTS

Figure 1:
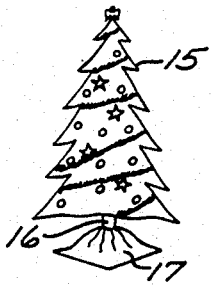
FIG. 1 is a perspective view of a Christmas tree with a first embodiment of a disposal bag of the present invention in place about the base of the tree in its folded and covered state.

As shown in the exemplary drawings, the present invention is embodied in a Christmas tree disposal bag 18 that in its most compact state 17 neatly stows beneath the Christmas tree (FIG. 1), unfolds to provide a large cover cloth or underlay (FIG. 2) and finally serves to enshroud the entire tree (FIG. 3) to facilitate its litter-free removal from within the house.

Figure 4:
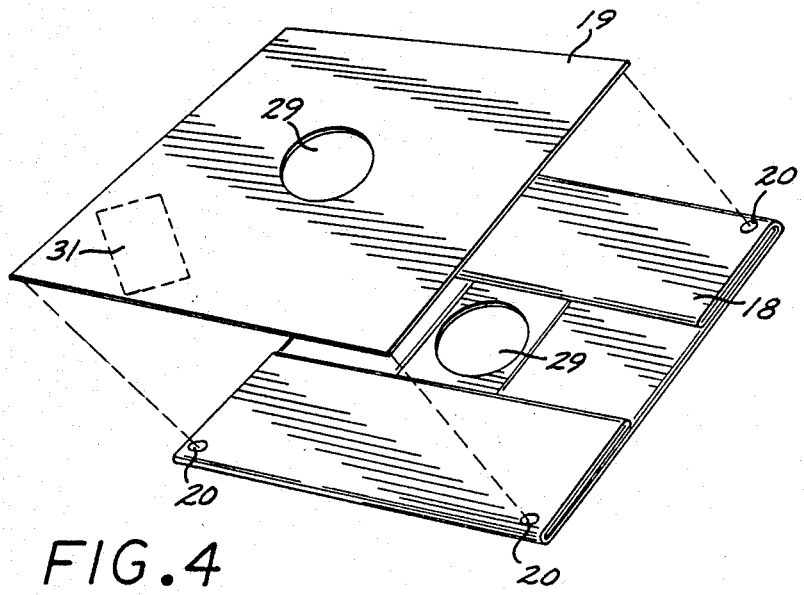
FIG. 4 is an enlarged perspective view showing the attachment of the overlay to the folded bag.
Figure 5:
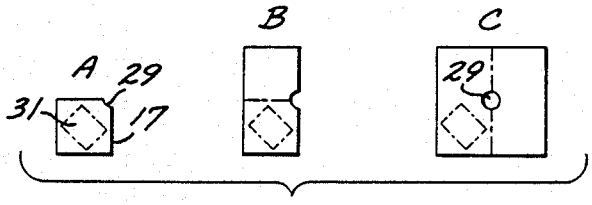
FIG. 5 is a top plan view showing the initial unfolding of the bag with the overlay in place.

FIG. 5*a* illustrates a disposal bag 18 embodying the present invention in its most compact state, the disposal bag 18 having been folded and covered by an easily removable decorative overlay 19, (as shown in FIG. 4) which had then been further folded down to a size easily handled at the distribution and retail level. Unfolded to the configuration illustrated in 5*c*, the covered disposal bag 17 shows a centrally located hole 29, which extends entirely through the overlay 19 and bag 18. The hole is dimensioned to approximate the diameter of the Christmas tree trunk 16 for which it is intended to be used. An appropriate adornment or inscription 31 thereon serves to camouflage the invention's rather utilitarian purpose within the Christmas setting.

The overlay 19 is easily removable to expose the folded disposal bag 18 thereunder. Ease of removal can be attained by either selection of a material that can easily be torn off such as a thin plastic or paper or selection of an adhesive that readily releases the attached overlay. FIG. 4 illustrates a preferred mode of attachment. The overlay 19 is attached directly to top face of the folded disposal bag 18 via four dabs of adhesive 20 each disposed at a corner. Such attachment is quickly accomplished and effectively prevents the bag 18 from unfolding.

Figure 7:
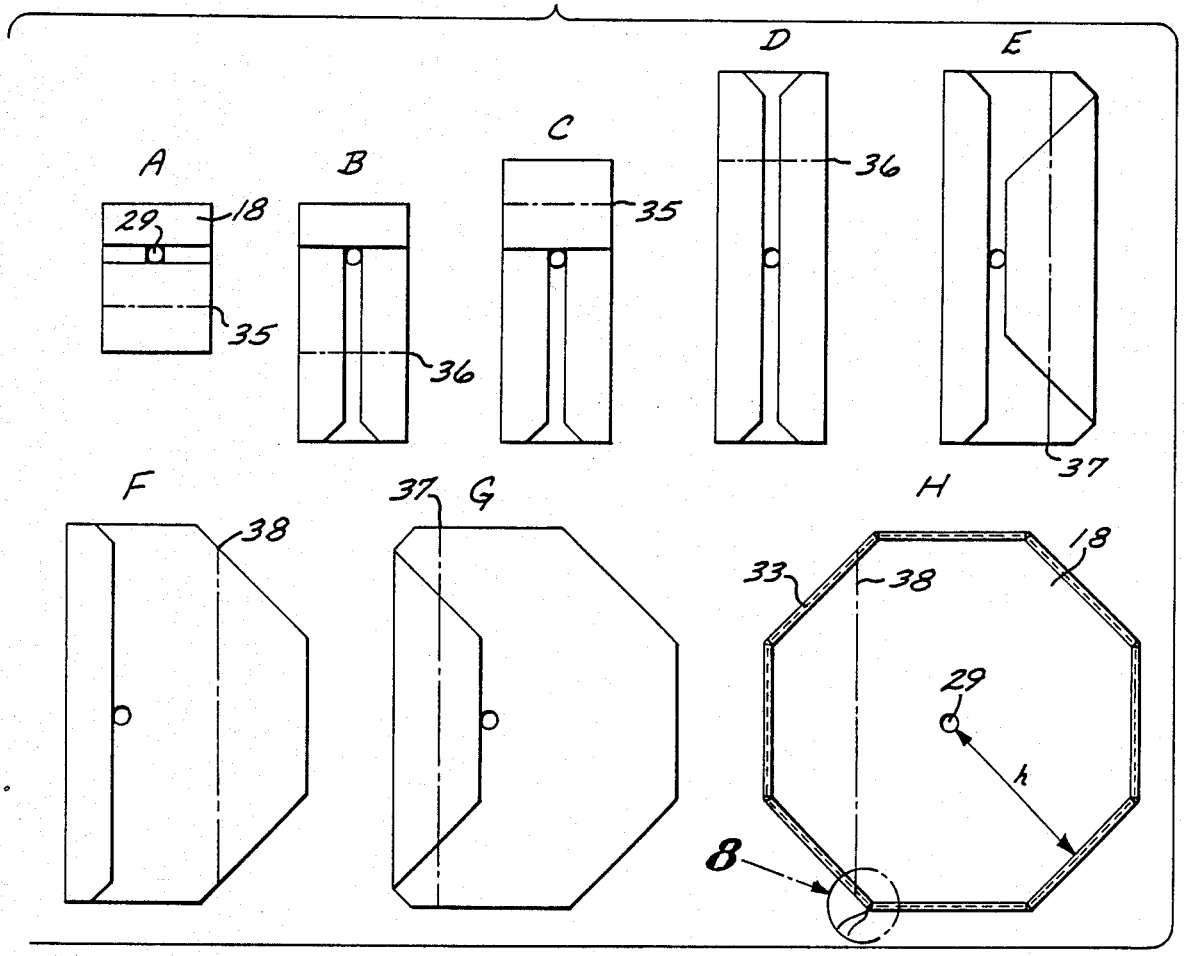
FIG. 7 is a top plan view of a sequence of the unfolding of the bag.
Figure 8:
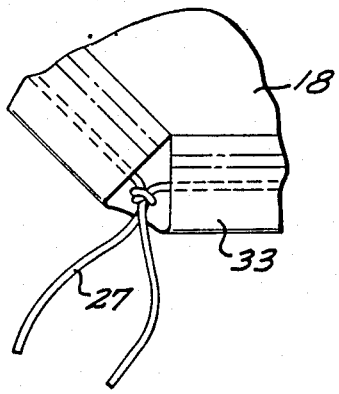
FIG. 8 is an enlarged view of the encircled portion of FIG. 7.

FIG. 7 illustrates the sequence in which the disposal bag as configured in an octagon is unfolded from the rather compact configuration pictured. As is apparent upon unfolding of the disposal bag 18, hole 29 is centrally located with dimension h to its outer periphery approximating the height of the Christmas tree 15 for which its use is intended. Illustrated in these figures is a regular octagon. Many different geometries can be used, regularity and symmetry of the configuration enables a neat and compact folding thereof. Fold lines 35-38 permit the octagon pictured to be folded down to a relatively small size. Besides the pictured octagon, different geometries such as squares, pentagons, hexagons, heptagons as well as nonagons, decagons, etc. up to and including a circle can be used to attain the purpose of the present invention. A drawstring 27 is attached about the periphery of the disposal bag 18. Said attachment comprises the location of a continuous strand 27 within a hemline 33 (FIG. 7).

A number of different materials can be used, such as for example, different types of paper or plastics. Polyethylene plastic, 2–10 mils thick comprises preferred choice of material. Selection of a naturally fire-retardant sheeting material, such as polyvinyl, or in the alternative, treatment or copolymerization of sheeting material, such as the polyethylene, with a fire-retardant chemical, such as for example aluminum trihydrate (ATH), antimony trioxide or polybromided diphenyl oxides is preferred and imparts the fire retarding advantages to the device.

In operation, the disposable bag of the present invention is purchased in the configuration illustrated in FIG. 5*a*. Prior to setting up the Christmas tree 15, the enveloped disposal bag 17 is unfolded to the configuration illustrated in FIG. 5*c* with the overlay in place. The tree trunk 16 is inserted through the hole 29 and then attached to the Christmas tree stand 21 which results in the general appearance illustrated in FIG. 1. The adorned 31 envelope 19 visible under the tree easily blends in with the setting and serves to hide the Christmas tree stand 21.

Figure 2:
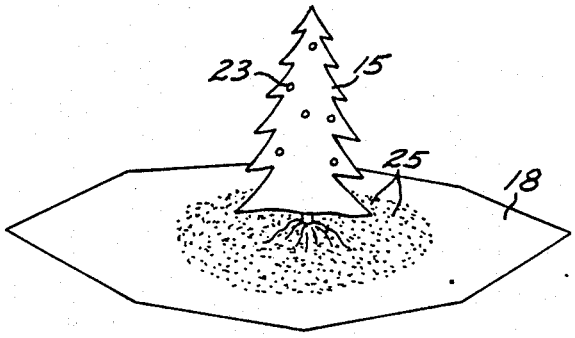
FIG. 2 is a perspective view similar to FIG. 1, but with said bag arranged in its unfolded state.
Figure 6:
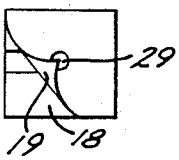
FIG. 6 is a top plan view of the bag with the overlay partially removed.

After the Christmas season has passed, when it comes time to dispose of the tree, the overlay 19 is detached and removed, and the disposal bag 18 is unfolded in the sequence illustrated in FIG. 6. This provides a large cover sheet extending well away from the tree as illustrated in FIG. 2. Needles 25 falling from the tree during removal of the ornamentation 23 fall onto the spread out disposal bag 18 instead of the carpeting. Finally the periphery of the disposal bag 18 is lifted towards the top of the tree 15 at which time the drawstring 27 is pulled tight and tied off. The remaining length of drawstring is wrapped about the enshrouded tree to yield the tidy package illustrated in FIG. 3. The tree 15 can now be removed from within the home without causing a trail of needles to be strewn in a path from the display site to the disposal site.

Figure 3:
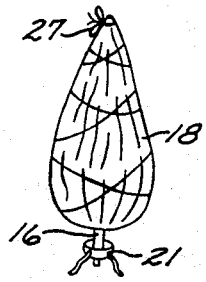
FIG. 3 is a perspective view similar to FIG. 1 and 2, but with the bag arranged in its final fully enshrouding configuration.

The fire-retardant property of both the overlay 19 and disposal bag 18 reduce the fire hazard associated with a Christmas tree. While in its display configuration (FIG. 1) within the house, the presence of the covered disposal bag 17 beneath the tree would prevent smoldering objects dropping thereon from igniting the carpeting. The tree 15 in its bagged configuration illustrated in FIG. 3 is less prone to igniting as it awaits collection at curb side by requiring a substantially deliberate effort to set it ablaze.

While particular forms of the invention have been illustrated and described, it will also be apparent that various modifications can be made without departing from the spirit and scope of the invention, and accordingly it is not intended that the invention be limited except as by the appended claims.

What is claimed is:

1. A combination disposal bag and underlay for a Christmas tree and the like, comprising:

flat sheeting material having a centrally located hole therein, said hole dimensioned to accept the trunk of such tree, said material extending outwardly in all directions from said hole a distance slightly greater than the height of such tree and further having fold lines therein to permit said sheeting to be folded in a regular compact flat configuration about the trunk of such tree;

a drawstring disposed about the periphery of said sheeting material to enable said periphery to be gathered up by pulling on said drawstring; and an easily removable attached overlay for covering and maintaining said sheeting material as folded in its flat, compact configuration about the trunk of such tree, said overlay having a hole therein coinciding with the hole in said sheeting material contained thereunder;

whereby said sheeting in its covered state as disposed about the trunk of such tree stows easily and unobtrusively beneath such tree and upon removal of said overlay and unfolding of said sheeting material, allows such tree to be readily disposed of without littering the surroundings .

2. The combination of claim 1 wherein the flat sheeting material has fire-retardant properties.

3. The combination of claim 1 wherein the overlay has fire-retarding properties.

4. The combination of claim 2 wherein the sheeting material comprises polyethylene plastic copolymerized with aluminum trihydrate.

5. The combination of claim 2 wherein the sheeting material comprises polyethylene plastic treated with antimony trioxide.

6. The combination of claim 2 wherein the sheeting material comprises polyethylene plastic formulated with polybromided diphenyl oxides.

7. The combination of claim 2 wherein the sheeting material comprises poly vinyl.

8. The combination of claim 3 wherein the overlay comprises polyethylene plastic copolymerized with aluminum trihydrate.

9. The combination of claim 3 wherein the overlay comprises polyethylene plastic treated with antimony trioxide.

10. The combination of claim 3 wherein the overlay comprises polyethylene plastic fomulated with polybromided diphenyl oxides.

11. The combination of claim 3 wherein the overlay comprises poly vinyl.

12. The combination of claim 1 wherein said flat sheeting material describes an octagon.

13. The combination of claim 12 wherein said fold lines enable said octagon to be folded into a square.

* * * * *